United States Patent [19]

Fulton

[11] Patent Number: 4,634,128

[45] Date of Patent: Jan. 6, 1987

[54] TRIATHLON TIME CHALLENGE GAME

[76] Inventor: Stephen M. Fulton, 8775 W. Ridgeville Rd., Morenci, Mich. 49256

[21] Appl. No.: 708,165

[22] Filed: Mar. 4, 1985

[51] Int. Cl.[4] ..... A63F 3/00

[52] U.S. Cl. ..... 273/246; 273/285

[58] Field of Search ..... 273/244, 249, 246, 277, 273/259, 258, 251, 252, 254

[56] References Cited

U.S. PATENT DOCUMENTS

| | | | |
|---|---|---|---|
| 1,741,832 | 12/1929 | Farrell | 273/246 |
| 3,652,086 | 3/1972 | Stecker . | |
| 4,095,799 | 6/1978 | Stringer | 273/241 |
| 4,241,924 | 12/1980 | Arcara | 273/277 |
| 4,244,581 | 1/1981 | Imatt | 273/282 |
| 4,432,553 | 2/1984 | Moore | 273/244 |

FOREIGN PATENT DOCUMENTS

| | | | |
|---|---|---|---|
| 2310785 | 12/1976 | France | 273/246 |
| 367096 | 3/1963 | Switzerland | 273/246 |
| 2026875 | 2/1980 | United Kingdom | 273/246 |
| 2048083 | 12/1980 | United Kingdom | 273/244 |

*Primary Examiner*—Richard C. Pinkham
*Assistant Examiner*—Matthew L. Schneider
*Attorney, Agent, or Firm*—Gifford, Groh, VanOphem, Sheridan, Sprinkle and Dolgorukov

[57] ABSTRACT

A board game based upon the three events of the triathlon race—swimming, cycling, and running, includes a flat and substantially rectangular playing board, a plurality of playing pieces representing the participants of the event, instruction and strategy cards, and a time sheet to record the cumulative time it requires a player to move his or her playing piece through the game course. The game board is illustrated with the race course which is divided into the three events. The course is further divided into individual segments or squares each representing a segment of time and distance. The winner of the game is the player to advance his or her playing pieces through the course utilizing the least number of time segments while overcoming the obstacles inherent to the triathlon.

20 Claims, 4 Drawing Figures

TRIATHLON TIME CHALLENGE GAME

BACKGROUND TO THE INVENTION

I. Field of the Invention

This invention relates to a board game and, in particular, to a board game based upon the three events of the triathlon, namely swimming, cycling and running.

II. Description of the Prior Art

Board games have been utilized to simulate a wide variety of activities. Previously known board games have simulated corporate activities, business undertakings, life's experiences, and various racing events.

Generally, these past devices utilize a flat playing surface which depicts the various situations or stages of the game. In order to provide an orderly progression for the game, a circular or elongated course is provided wherein the course is divided into a series of segments. These individual segments or "squares" contain additional instructions or permit the player to progress towards the ultimate goal of the game. To mark a player's progress, individually shaped or colored game pieces may be provided to distinguish the participants. Each of these playing pieces is advanced according to a roll of a die or the instructions provided along the game course. In addition, playing cards may be included which further control movement of the playing pieces or game strategy.

In most instances, the winner of the game is the first player to advance his or her playing piece through the entire game board. However, some games require each individual to accumulate certain objects, such as currency, or to eliminate all other players of the game. These types of games generally require a certain amount of strategy rather than the luck of the die.

Although the themes for board games vary widely, none of the prior board games combines the theme of the modern triathlon with the strategy of speed and endurance required in the three events of the triathlon—swimming, cycling and running. Of the prior games based upon racing events, generally very little strategy is involved as the participants rely on the luck of the die and the instructions contained in the individual squares of the games board to move as quickly as possible through the game course.

SUMMARY OF THE PRESENT INVENTION

The present invention provides a board game based upon the triathlon which requires the players to move their playing pieces through the game course as quickly as possible to simulate speed, while utilizing individual strategy to simulate endurance.

The game according to the present invention comprises a flat and substantially rectangular game board which illustrates the triathlon race course. This course is divided into a plurality of course segments or "squares" which represent segments of time and distance. The course is further divided into separate event segments representing the swimming, cycling and running events of the triathlon. Each of the game participants is provided with three playing pieces representing a swimmer, a biker and a runner, and these playing pieces are utilized on the appropriate segment of the course.

In order to advance the playing pieces through the game course, a die or similar numerated device is utilized. Additionally, three different types of playing cards for each of the course segments further advance or hinder the progress of the player. Because the object of the game is to advance through the course in the minimum time while enduring the obstacles inherent to the triathlon, time sheets are provided for recording overall "time" through the course, which is a function of the die rolls and race obstacles.

BRIEF DESCRIPTION OF THE DRAWING

The present invention will be more fully understood by reference to the following detailed description of the preferred embodiment of the present invention when read in conjunction with the accompanying drawing in which like reference characters refer to like parts throughout the views, and in which.

DETAILED DESCRIPTION OF THE PREFERRED EMBODIMENT

Figure 1A:
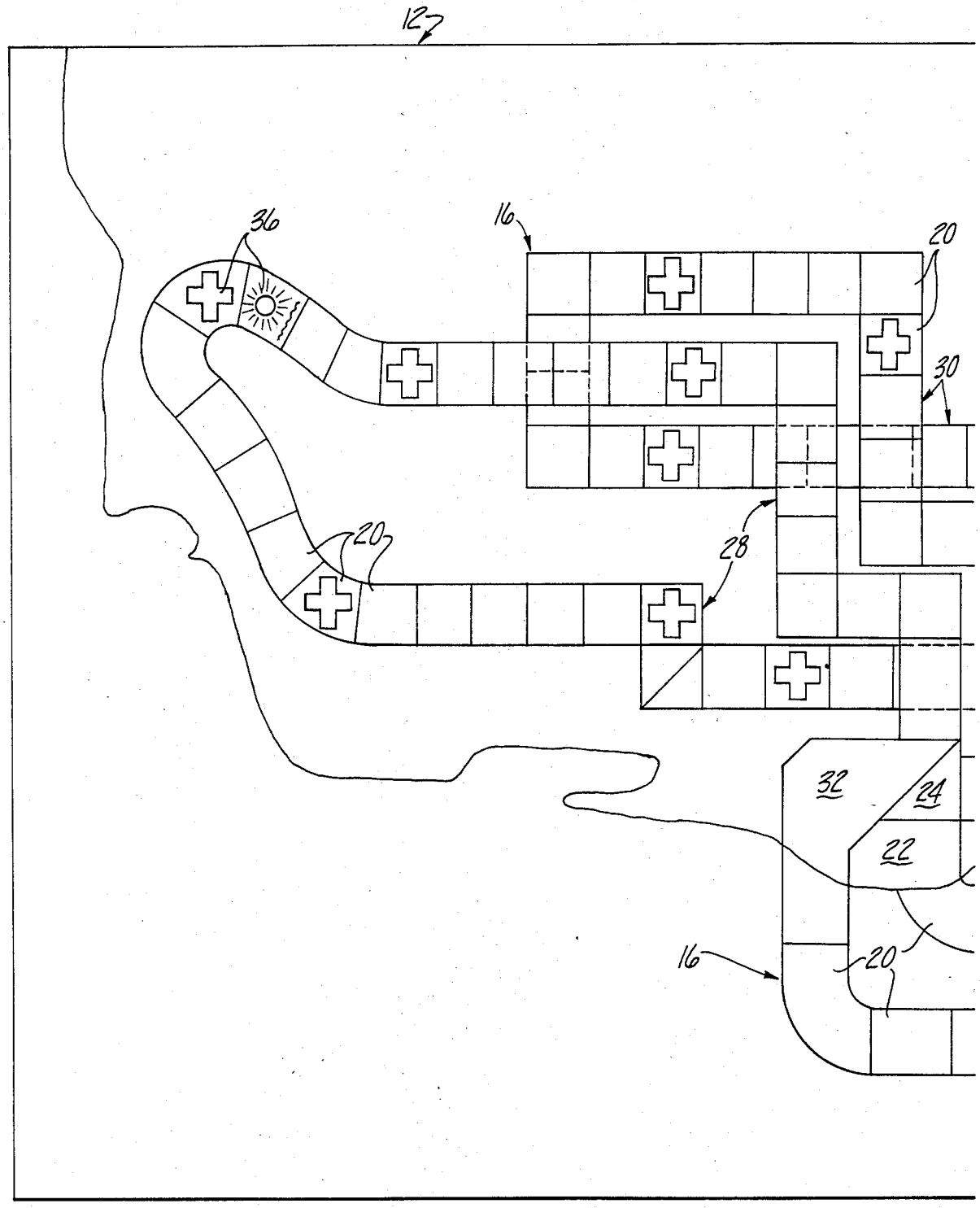
FIG. 1A is a partial plan view of an embodiment of the playing surface of the present invention.
Figure 1B:
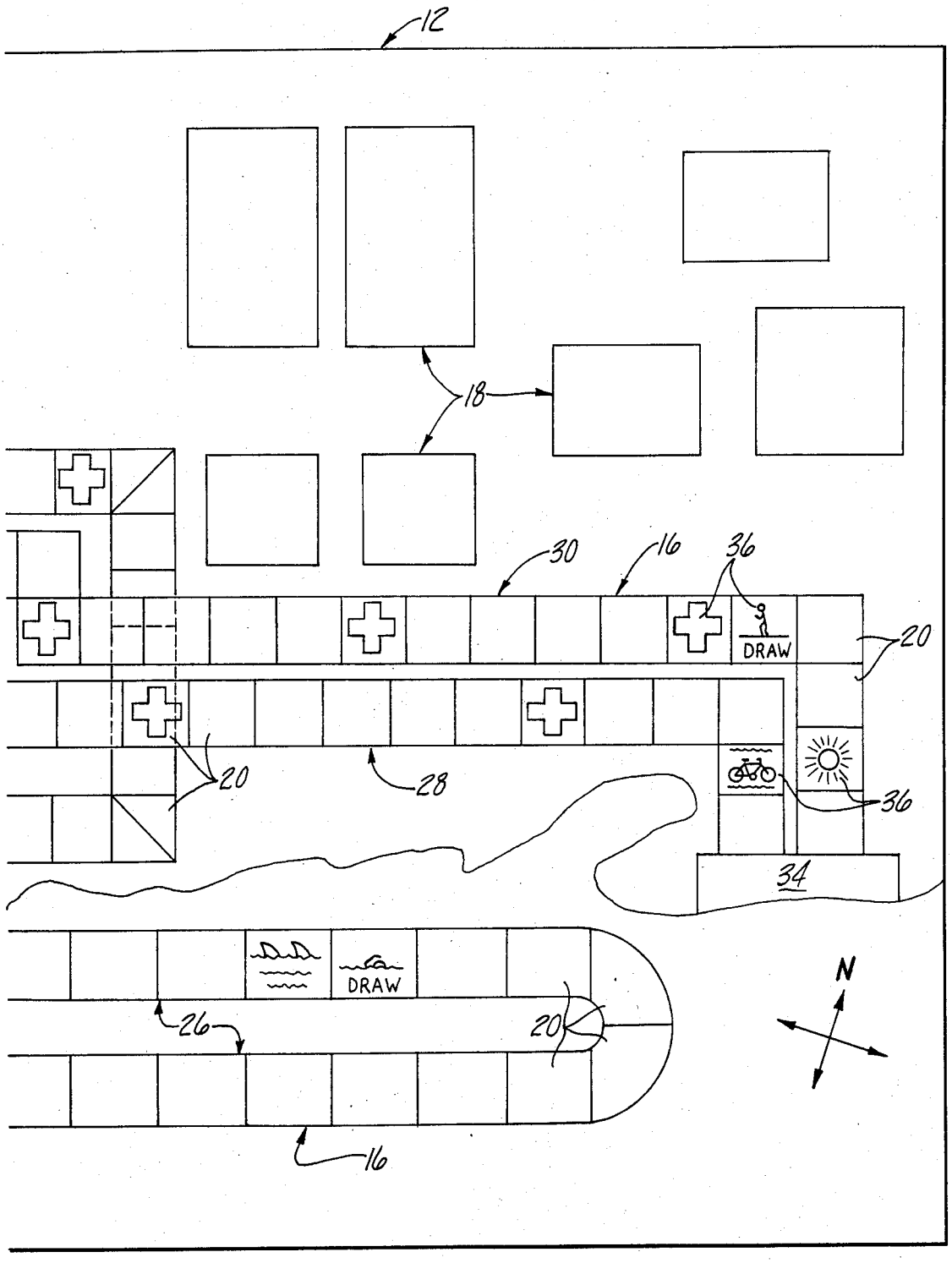
FIG. 1B is an additional partial plan view of an embodiment of the playing surface of the present invention.
Figure 3:
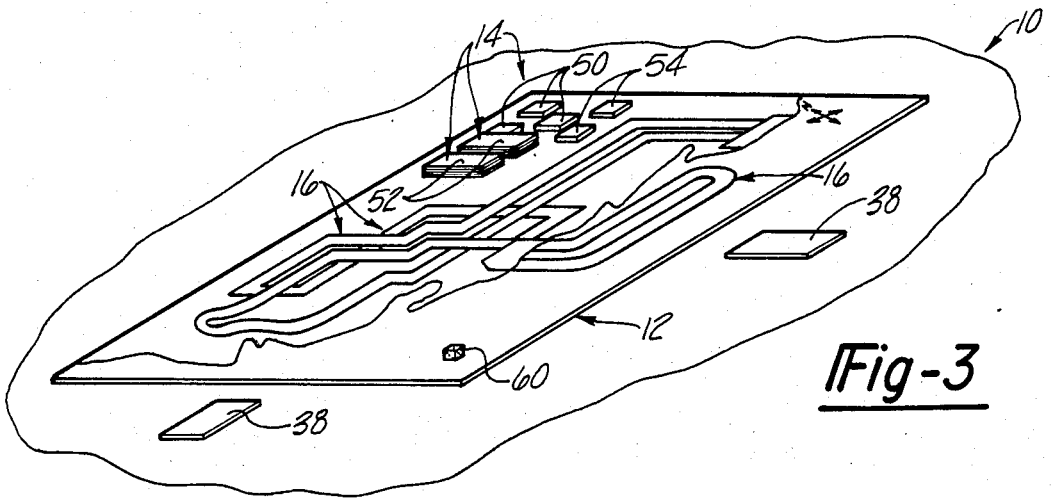
FIG. 3 is an elevated perspective of the preferred embodiment of the present invention in use.

Referring to FIGS. 1A and 1B and generally to FIG. 3, there is shown a triathlon board game 10 embodying the present invention and comprising a playing board 12 and several decks of instructional playing cards 14. The board game 10 of the preferred embodiment simulates the events of the triathlon competition generally including swimming, cycling and running. However, the same underlying concept may be utilized to simulate any combination of events including a biathlon or marathon. The board game 10 and its operation will be described in greater detail hereinafter.

The playing board 12 comprises various graphic illustrations including a game course 16 and several card placement squares 18. The playing board 12 is preferably flat and divided into two or more portions for ease of manufacture and storage. However, it is to be understood that the playing board 12 may be any shape and may also include contours to simulate physical features.

Referring to FIGS. 1A and 1B, the game course 16 is divided into a plurality of contiguous segments 20 which represent individual spaces or time segments along the game course 16. In addition to the intermediate segments 20, the game course 16 also consists of a start segment 22 and a finish segment 24 which define the start and finish of the game and the race which the game simulates. The individual segments 20 may be any shape which permits distinguishing the contiguous spaces from one another although the preferred embodiment utilizes generally rectangular segments 20. Moreover, the game course 16 shown in FIGS. 1A and 1B simulates the course and environment of the Ironman Triathlon, a triathlon championship held annually in Hawaii, and is not designed as a limitation of the shape of the game course 16.

Referring still to FIGS. 1A and 1B, the game course 16 is also divided into a swimming portion 26, a cycling portion 28 and a running portion 30 which represent the three events of a triathlon competition. Moreover, the three portions 26, 28, and 30 are separated by transition segments 32 and 34 wherein transition segment 32 separates the swimming portion 26 and the cycling portion 28, and transition segment 34 separates the cycling portion 28 and the running portion 30. Each of the transition segments 32 and 34 represents a changeover area utilized to prepare the participant for the next event. In the actual triathlon competition these changeover areas allow the participant to change clothing and equipment, thus causing delays. Again, although the preferred embodiment of the present invention is based upon the three event triathlon, it is to be understood that the same underlying concept can be utilized to simulate a wide variety of competitions.

Figure 2:
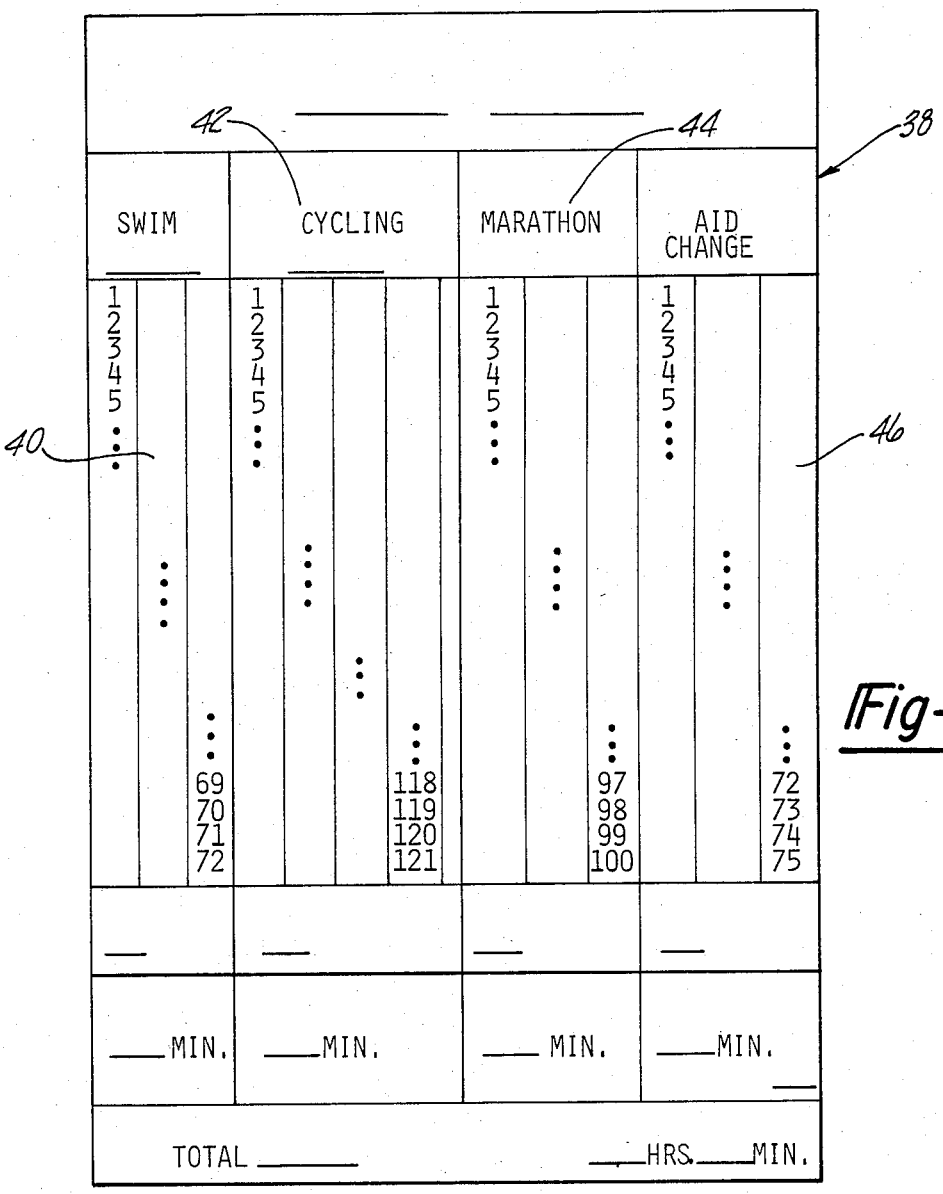
FIG. 2 is a plan view of the time sheets for recording a player's advancement through the game course.

In addition to the playing board 12 and the playing cards 14, each player is provided with a playing piece (not shown) and a time sheet 38 (FIG. 2). The playing pieces are utilized to indicate a player's position along the game course 16 and may be any convenient shape. In the preferred embodiment, each player is provided with three playing pieces corresponding to the three events and each representing an athlete competing in the particular event. The playing pieces are preferably color coded to distinguish the participants.

As is best shown in FIG. 2, the time sheets 38 are utilized to record a player's advancement through the game course 16. The time sheets 38 are preferably divided into four sections with section 40 utilized to record advancement during the swimming portion 26, section 42 utilized to record advancement during the cycling portion 28, and section 44 utilized to record advancement during the running portion 30. Section 46 of the time sheet 38 is utilized to record disposal of the playing cards 14 during the course of the game. Use of the time sheets 38 and the playing cards 14 will be subsequently described below in conjunction with the description of play.

The playing cards 14 provide further instruction regarding movement of a participant's playing piece and preferably include a set of instruction cards 50, a set of aid cards 52 and a set of change cards 54. Moreover, a set of instruction cards 50 is provided for each of the swimming portion 26, the cycling portion 28 and the running portion 30 in order to more closely simulate actual race conditions. Similarly, aid cards 52 are provided for each of the cycling and running portions 28 and 30. The change cards 54 are utilized during the two transition segments 32 and 34 and a set of change cards 54 is provided for each of the first transition area 32 and the second transition area 34. Although the preferred embodiment utilizes seven sets of playing cards 14 it is to be understood that any combination of playing cards 14 may be used including combining similar sets of cards.

Playing the board game 10 of the preferred embodiment is straightforward and may be played with any number of participants. In the preferred embodiment, each player is provided three playing pieces (not shown) depicting an athlete in each of the three events. One piece is placed in the appropriate starting area, i.e. the swimming piece in the start segment 22; the cycling piece in the first transition segment 32; and the running piece in the second transition segment 34. In addition, the playing cards 14 are placed in their corresponding card placement squares 18.

Advancement of a participant's playing piece is made according to a random selection means which in the preferred embodiment is a conventional die 60. A roll of four on the die 60 allows the participant to advance his or her playing piece a total of four segments 20. In addition to the rolls of the die 60, advancement of a playing piece is affected by the instruction cards 50 and the additional instruction segments 36 in a limited number of the segments 20. Thus, in the event that the player's roll of the die 60 causes him to advance his playing piece to a "Draw" instruction segment 36, the player must draw one of the instruction cards 50 corresponding to the particular event or portion through which the playing piece is being advanced.

The instruction cards 50 limit the advancement of a player's piece by instructing the player to wait a certain number of rolls prior to further advancement. For example, a drawn instruction card 50 may read "+3" along with a humorous reason for the delay. On the player's next roll of the die 60, the "three" must be absorbed prior to advancement. Thus, in the event the player rolls a five, three are absorbed by the instruction card and the player advances the playing piece only two segments 20. However, as will be subsequently described, the entire roll (i.e. five) must be recorded on the time sheet 38.

The players advance their playing pieces through the swimming portion 26 until the swimming/cycling transition segment 32 is reached. At this juncture, the player is provided with a number of options. In the event that an exact roll of the die 60 causes the player to move his or her playing piece to the transition segment 32 the player is allowed to draw a change card 54. However, in the event that a roll of the die 60 does not permit exact placement of the playing piece within the transition segment 32, the player may either stop his/her playing piece within the transition segment 32 and draw a change card 54 or, alternatively, move the playing piece through the transition segment 32 without drawing a change card 54. In either event, the player's full roll is recorded on the time sheet 38 for the corresponding event. Additionally, each change card 54 comprises additional time which also must be recorded on the time sheet 38.

Upon advancing through the first transition segment 32, the players preferably change playing pieces (not shown) and begin utilizing the playing piece depicting a cyclist. As with the swimming portion 26, the cycling portion 28 comprises segments 20 which contain instructions to the players. In addition to the segments 36 which instruct the player to draw an instruction card 50 or to further advance his/her playing piece, the cycling portion 28 and the running portion 30 also comprise segments 36 which require the players to draw an aid card 52. A player may stop his/her playing piece at any aid segment 36, but the player's entire roll must be recorded on the time sheet 38. Upon drawing an aid card 52, the time assessment noted on the aid card 52 must be recorded on the time sheet 38. Thereafter, when a player lands on a segment 20 instructing him/her that aid is needed, the aid card 52 may be turned in without penalty. In the event that the player does not possess an aid card 52, the player is assessed the penalty noted on the "aid needed" instruction segment 36. In addition to the "aid needed" and "draw" instruction segments 36, segments which require the player to exchange combinations of aid cards 52 and change cards 54 to remain in the game, are also located along the game course 16.

Determination of the winner of the board game 10 is not necessarily based upon the first to finish the game course 16. Time sheets 38 are provided to each player for recording the "time" which it takes to finish the course 16. Each point on the roll of the die 60 is recorded in the appropriate area on the time sheet 38 whether the playing piece is advanced or not. Rolls during the swimming portion 26 are recorded in the first section 40 of the time sheet 38, rolls during the cycling portion 28 are recorded in the second section 42, and rolls during the running portion are recorded in the third section 44. Additionally, the assessment of time noted on the aid cards 52 and the change cards 54 is recorded in the fourth section 46 of the time sheet 38. Upon reaching the end of the course 16, the player's total time is tallied and the player with the lowest total time is the winner. In addition to the total time, each player may also be given credit corresponding to unused aid cards 52 and change cards 54.

Thus, the board game 10 of the preferred embodiment provides an exciting yet simple simulation of the triathlon competition. The game 10 requires continued use of strategy to overcome the obstacles of the grueling competition. Although the preferred embodiment simulates the three events of the triathlon, any combination of events may be utilized.

The foregoing detailed description has been given for clearness of understanding only and no unnecessary limitations should be understood therefrom as some modifications will be obvious to those skilled in the art.

I claim:

1. A board game based upon the triathlon athletic event consisting of the three events swimming, cycling, and running, said game comprising:

a game board;

an elongated game course affixed to said game board wherein said game course is divided into a plurality of contiguous segments and wherein said game course is further divided into three portions, said three portions comprising a first portion representing a first one of the events, a second portion representing a second one of the events and a third portion representing a third one of the events;

indicating means for indicating a player's position along said game course;

random selection means for advancing said indicating means along said plurality of segments of said game course; and means for recording said advancement through said game course and determining a player's score therefrom;

wherein said course additionally comprises a first transition segment between and connecting said first and second portions of said game course, and a second transition segment between and connecting said second and third portions of said game course.

2. The board game as defined in claim 1 and further comprising at least one set of playing cards wherein said playing cards provide instruction affecting said advancement of said indicating means.

3. The board game as defined in claim 2 wherein said at least one set of playing cards comprises a first set of instruction cards, a second set of aid cards, and a third set of change cards.

4. The board game as defined in claim 2 wherein at least one of said plurality of game course segments contains instructions for drawing said playing cards.

5. The board game as defined in claim 2 wherein at least one of said plurality of game course segments contains instructions for surrendering said playing cards.

6. The board game as defined in claim 1 wherein said first portion of said game course represents the swimming event; wherein said second portion of said game course represents the cycling event; and wherein said third portion of said game course represents the running event.

7. The board game as defined in claim 6 wherein a starting segment precedes said first portion of said game course and wherein a finishing segment succeeds said third portion of said game course.

8. The board game as defined in claim 1 wherein said indicating means comprises at least one playing piece for each player of the game.

9. The board game as defined in claim 1 wherein said indicating means comprises three playing pieces for each player of the game.

10. The board game as defined in claim 9 wherein a first playing piece indicates a player's position along said first game portion; wherein a second playing piece indicates a player's position along said second game portion; and wherein a third playing piece indicates a player's position during said third game portion.

11. The board game as defined in claim 1 wherein said random selection means comprises at least one numbered die.

12. The board game as defined in claim 1 wherein said means for recording said advancement comprises at least one time sheet for recording the number of said game course segments entered by said indicating means wherein said individual game course segments represent a defined unit of time.

13. The board game as defined in claim 12 wherein said time sheet is divided into four sections and wherein a first of said sections is utilized to record said units of time during said first portion of said game course; a second of said sections is utilized to record said units of time during said second portion of said game course; and a third of said sections is utilized to record said units of time during said third portion of said game course.

14. The board game as defined in claim 13 wherein a fourth section of said time sheet is utilized to record said playing cards.

15. The board game as defined in claim 1 wherein said game board is flat.

16. The board game as defined in claim 1 wherein said game board comprises a plurality of sections whereby said game board may be folded and stored.

17. The board game as defined in claim 1 and further comprising score-affecting means associated with said transition segments.

18. The board game as defined in claim 17 wherein said transition segment-associated score-affecting means comprises cards having indicia representative of a delay associated with a participant's change of clothing and equipment at said first and second transition segments.

19. The board game as defined in claim 1 and comprising at least one set of playing cards bearing thereon indicia affecting said advancement of said indicating means; wherein at least one of said plurality of course segments bears indicia thereon directing a player to randomly select one of said playing cards when said player's indicating means rests on said at least one segment, said at least one segment being representative of an aid locus of one of said events; and wherein said game further comprises means for obviating the effect of said playing card indicia, obtainable by surrendering in exchange a portion of the advancement afforded by said random selection means.

20. The board game as defined in claim 19 and comprising at least two of said at least one indicia-bearing segments, wherein said obviating means is obtainable at a first of said at least two segments and useful for obviation at a second of said at least two segments.

* * * * *